US006386268B1

(12) United States Patent
Weyer et al.

(10) Patent No.: US 6,386,268 B1
(45) Date of Patent: May 14, 2002

(54) METHOD FOR ADJUSTING A CONTINUOUS CASTING INSTALLATION ROLL SEGMENT

(75) Inventors: Axel Weyer, Wuppertal; Wolfgang Schmitt, Meerbusch; Ralf Hartmann; Christian Geerkens, both of Düsseldorf, all of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/623,585

(22) PCT Filed: Feb. 25, 1999

(86) PCT No.: PCT/EP99/01222

§ 371 Date: Oct. 30, 2000

§ 102(e) Date: Oct. 30, 2000

(87) PCT Pub. No.: WO99/46071

PCT Pub. Date: Sep. 16, 1999

(30) Foreign Application Priority Data

Mar. 9, 1998 (DE) ..... 198 09 807

(51) Int. Cl.[7] ..... B22D 11/20; B22D 11/128; B22D 11/16; B21B 31/07

(52) U.S. Cl. ..... 164/454; 164/484; 164/413; 72/245

(58) Field of Search ..... 164/454, 413, 164/484, 441, 442, 447, 448; 492/1, 2, 6, 9, 10; 72/466.3, 245

(56) References Cited

U.S. PATENT DOCUMENTS

| | | | | |
|---|---|---|---|---|
| 3,776,298 A | * | 12/1973 | Vogt | 164/154 |
| 3,812,900 A | * | 5/1974 | Bollig et al. | 164/76 |
| 4,091,862 A | * | 5/1978 | Lehmann et al. | 164/447 |
| 5,165,266 A | * | 11/1992 | Ginzburg | 72/20 |
| 5,348,074 A | | 9/1994 | Streubel | |
| 6,199,621 B1 | * | 3/2001 | Weyer et al. | 164/484 |
| 6,209,619 B1 | * | 3/2001 | Mörwald et al. | 164/454 |

FOREIGN PATENT DOCUMENTS

| | | | |
|---|---|---|---|
| DE | 2133144 | | 1/1973 |
| DE | 196 27 336 C1 | | 9/1997 |
| WO | WO-98/00253 | * | 1/1998 |
| WO | 9850185 | | 11/1998 |
| WO | WO-98/50185 | * | 11/1998 |

OTHER PUBLICATIONS

Patent Abstracts of Japan, vol. 013, No. 432 (M–874), Sep. 27, 1989 & JP 01 166863 A (Nippon Steel Corp), Jun. 30, 1989.

* cited by examiner

*Primary Examiner*—M. Alexandra Elve
*Assistant Examiner*—Kevin McHenry
(74) *Attorney, Agent, or Firm*—Friedrich Kueffner

(57) ABSTRACT

The present invention relates to an adjusting method for a roller section of a continuous casting machine which is provided with a section input side (6), a section output side (7) and a pair of roller carriers (1, 2) which each carry at least two rollers (3) extending over a supporting zone (4), with the roller carriers (1, 2) being mutually adjusted against one another by way of an adjusting unit arranged at the section input side (6) and at the section output side (7), with each adjusting unit being provided with two hydraulic cylinder units (8 to 11) arranged on either side of the supporting zone (4), characterized in that the hydraulic cylinder units (8 to 11) can be adjusted both in a position-controlled and pressure-controlled manner;

the rollers (3) are placed in a position-controlled manner by the hydraulic cylinder units (8 to 11) against a metal billet (5) which is guided by the rollers (3);

the hydraulic cylinder units (8 to 11) are changed over from position-controlled to pressure-controlled operation when the pressure in the respective hydraulic cylinder unit (8 to 11) reaches a hydraulic cylinder threshold value.

11 Claims, 2 Drawing Sheets

METHOD FOR ADJUSTING A CONTINUOUS CASTING INSTALLATION ROLL SEGMENT

The present invention relates to an adjusting method for a roller section of a continuous casting machine which is provided with a section input side and a section output side and a pair of roller carriers which each carry at least two rollers extending over a supporting zone, with the roller carriers being mutually adjustable towards one another by means of an adjusting unit arranged at the section input side and section output side, with each adjusting unit being provided with hydraulic cylinder units on either side of the supporting zone.

Such an adjusting method is known from DE 196 27 336 C1 for example.

During the continuous casting of metal for example, and during the casting of a steel strip in particular, the solidifying billet is drawn off and supported via a roller course with a plurality of supporting rollers. In order to ensure the precisest possible guidance of the billet, the roller course is broken down into several sections according to DE 196 27 336 C1 which can be adjusted separately.

Bellying can occur in the still cast-heated metal billets, which moreover are not yet solidified in the core region. When such a bellying passes through a roller section, an even larger force than usual is exerted on the section. This may under certain circumstances lead to damage to the roller section. Moreover, the bellying must be compensated again during the further processing of the metal billet.

It is the object of the present invention to provide an adjusting method by means of which damage to the roller section as a result of excessive exertion of force can be avoided in any case and, moreover, bellying can be eliminated to the highest possible extent.

This object is achieved in such a way that the hydraulic cylinder units are adjustable both in a position-controlled as well pressure-controlled manner, that the rollers are moved via the hydraulic cylinder units in a position-controlled manner towards a metal billet which is supported by the same and that the hydraulic cylinder units can be changed over from position-controlled to pressure-controlled operation when the pressure in the respective hydraulic cylinder unit reaches a hydraulic cylinder threshold value.

Preferably, a hydraulic cylinder unit will also be changed over from a position-controlled to a pressure-controlled operation when the pressure in the other hydraulic cylinder unit of the same adjusting unit reaches the hydraulic cylinder threshold value. This substantially causes a synchronism between the two hydraulic cylinder units of each adjusting unit.

Any overload of the rollers can be avoided in a simple manner when the hydraulic cylinder units of an adjusting unit are changed over from a position-controlled to pressure-controlled operation when the sum total of the pressures in the hydraulic cylinder units of the adjusting unit reaches an adjusting unit,threshold value.

Similarly, an overload of the roller section can be avoided when all hydraulic cylinder units of the roller section are changed over from position-controlled to pressure-controlled operation when the sum total of the pressures in the hydraulic cylinder units reaches a section threshold value.

In an embodiment of the present invention the adjusting unit produces after the changeover from the positional control to pressure or force control a permanent form closure between the metal billet and the rollers. As a result of this measure, bellying of the metal billet and, optionally, its break-out are avoided. The form closure between the metal billet and the rollers ensures the rotation of the rollers and thus their optimized cooling. Moreover, the form closure produces the continuous conveyance of the metal billet between the rollers.

The hydraulic cylinder threshold value, the adjusting unit threshold value and the section threshold value are preferably parameterizable in order to enable the adjustment to the constructional conditions of the roller section.

Further advantages and details are revealed by the description of an embodiment below. The elementary drawings show as follows.

Figure 1:
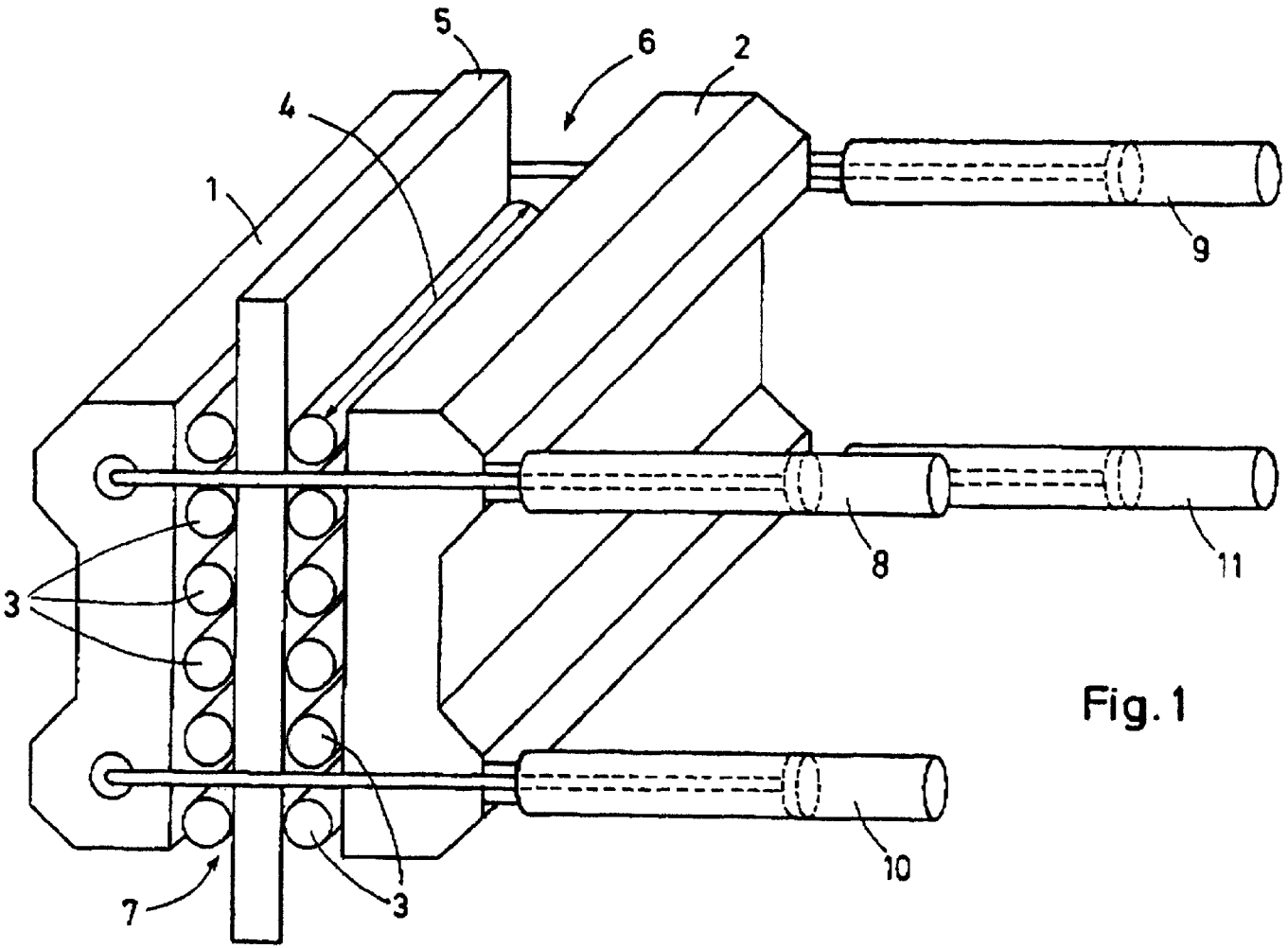
FIG. 1 shows a roller section of a continuous casting machine.

In accordance with FIG. 1, a roller section of a continuous casting machine is provided with two roller carriers 1, 2, each with six rollers 3. Rollers 3 extend over a supporting zone 4. The roller carriers 1, 2 are placed with their rollers 3 in the supporting zone 4 against a metal billet 5, which is a steel strip 5 in this case The metal billet 5 enters the roller section at a section input side 6 and leaves the section again at a section output side 7.

The roller carriers 1, 2 are mutually connected by way of two adjusting units. The one adjusting unit is provided with two hydraulic cylinder units 8, 9 which are arranged at either side of the supporting zone 4 at the section input side 6. The other adjusting unit is provided with two hydraulic cylinder units 10, 11 which are arranged on either side of the supporting zone 4 at the section output side 7. The roller carriers 1, 2 are mutually adjustable by means of the adjusting units.

Figure 2:
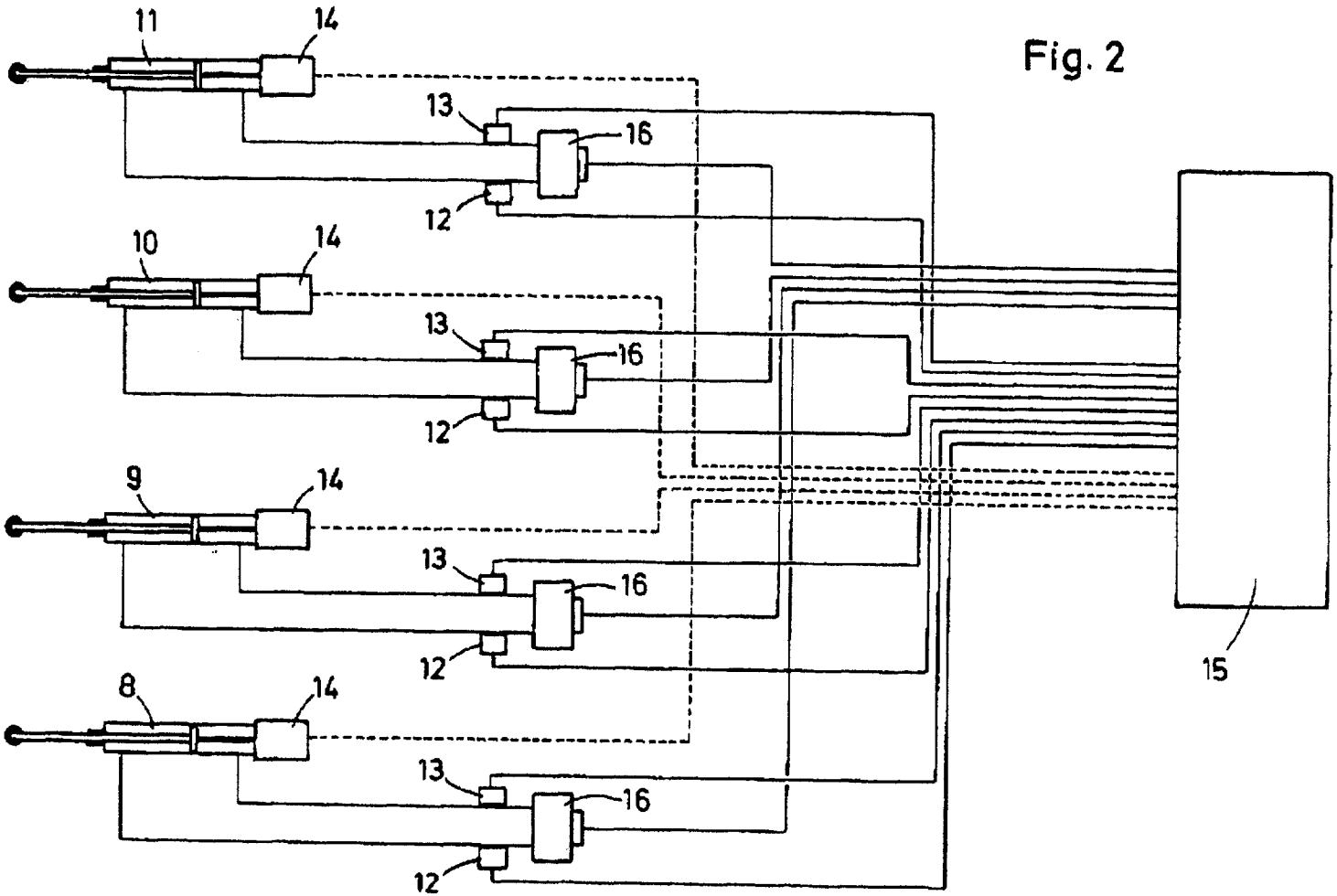
FIG. 2 shows a control circuit for driving the roller section.

Each of the hydraulic cylinder units 8 to 11 can be controlled both with respect to position and pressure. According to FIG. 2 each of the hydraulic cylinder units 8 to 11 are therefore assigned pressure sensors 12, 13 and locators 14. Their output signals are transmitted to a computer unit 15. The computer unit 15 determines the actuating signals for the hydraulic cylinder units 8 to 11 and sends the same to the control valves 16, so that the hydraulic cylinder units 8 to 11 can be moved for setting.

At the beginning of a casting process all hydraulic cylinder units 8 to 11 are moved in such a way that the rollers 3 of the roller carriers 1, 2 are placed against the metal billet 5 in a position-controlled way. The hydraulic cylinder units 8 to 11 are driven synchronously for each adjusting unit. The settings to which the hydraulic cylinder units 8 to 11 are adjusted are determined by the computer unit 15 independent from one another. The settings are determined by the computer unit 15 and sent as predetermined values to the hydraulic cylinder units 8 to 11 in such a way that force-induced spring-backs (e.g. of the roller carriers 1, 2) are compensated. The position-controlled placement of the rollers 3 on metal billet 5 is maintained until (as a result of a bellying in the metal billet 5 for example) the pressure in one of the hydraulic cylinder units 8 to 11 (e.g. hydraulic cylinder unit 8 for example) reaches a hydraulic cylinder threshold value. When the pressure in this hydraulic cylinder unit 8 reaches a hydraulic cylinder threshold value, this hydraulic cylinder unit 8 is changed over to pressure-controlled operation.

The hydraulic cylinder unit 8 then holds the pressure at the hydraulic cylinder threshold value and therefore yields.

In principle it is possible to control each of the hydraulic cylinder units 8 to 11 in such a way independently from one another. Preferably, however, the hydraulic cylinder units 8 to 11 of the adjusting units are changed over in groups. The hydraulic cylinder unit 9 is therefore changed over from position-controlled operation to pressure-controlled operation simultaneously with the hydraulic cylinder unit 8.

In accordance with the present invention, not only the individual pressures prevailing in the hydraulic cylinder units 8 to 11 are compared with the hydraulic cylinder threshold value, but summary values are also formed and compared with further threshold values. Thus, the hydraulic cylinder units 8 and 9 are changed over for example from position-controlled to pressure-controlled operation when the sum total of the pressures in the hydraulic cylinder units 8 and 9 reaches an adjusting unit threshold value. Similarly, the hydraulic cylinder units 10 and 11 are changed over from position-controlled to pressure-controlled operation when the sum total of the pressures in the hydraulic cylinder units 10 and 11 reaches the adjusting unit threshold value. Moreover, all four hydraulic cylinder units 8 to 11 are changed over simultaneously from position-controlled to pressure-controlled operation when the sum total of the pressures in the hydraulic cylinder units 8 to 11 reaches a section threshold value.

The hydraulic cylinder threshold value, the adjusting unit threshold value and/or the section threshold value are preferably parameterizable so as to enable the adjustability to the concrete conditions of the roller section. In particular, the threshold values can be parameterized in such a way that overloads of the roller carriers 1, 2, the rollers 3 and the roller pins (not shown) of rollers 3 and the bearings (also not shown) for the roller pins are avoided.

LIST OF REFERENCE NUMERALS

2 Roller carriers
3 Rollers
4 Supporting zone
5 Metal billet
6 Section input side
7 Section output side
8 to 11 Hydraulic cylinder units
12, 13 Pressure sensors
14 Locator
15 Computer unit
16 Control valves What claimed is:

1. An adjusting method for a roller section of a continuous casting machine which is provided with a section input side (6), a section output side (7) and a pair of roller carriers (1, 2) which each carry at least two rollers (3) extending over a supporting zone (4), with the roller carriers (1, 2) being adjusted against one another by way of an adjusting unit arranged at the section input side (6) and at the section output side (7), with each adjusting unit being provided with two hydraulic cylinder units (8 to 11) arranged on either side of the supporting zone (4), wherein the hydraulic cylinder units (8 to 11) can be adjusted both in a position-controlled and pressure-controlled manner;

the rollers (3) are placed by the hydraulic cylinder units (8 to 11) in a position-controlled manner against a metal billet (5) which is guided by the rollers (3);

the hydraulic cylinder units (8 to 11) are changed over from position-controlled to pressure-controlled operation when the pressure in the respective hydraulic cylinder unit (8 to 11) reaches a hydraulic cylinder threshold value.

2. The adjusting method as claimed in claim 1, wherein a hydraulic cylinder unit (e.g. 9) will also be changed over from position-controlled to pressure-controlled operation when the pressure in the other hydraulic cylinder unit (e.g. 8) of the same adjusting unit reaches the same hydraulic cylinder threshold value.

3. The adjusting method as claimed in claim 1, wherein the hydraulic cylinder threshold value is parameterizable.

4. The adjusting method as claimed in claim 1, wherein the hydraulic cylinder units (8, 9; 10, 11) of an adjusting unit will be changed over from position-controlled to pressure-controlled operation when the sum total of the pressures in the hydraulic cylinder units (8, 9; 10, 11) of the adjusting unit reaches an adjusting unit threshold value.

5. The adjusting method as claimed in claim 4, wherein the adjusting unit threshold value is parameterizable.

6. The adjusting method as claimed in claim 1, wherein all hydraulic cylinder units (8 to 11) of the roller section will be changed over from position-controlled to pressure-controlled operation when the sum total of the pressures in the hydraulic cylinder units (8 to 11) reaches a section threshold value.

7. The adjusting method as claimed in claim 6, wherein the section threshold value is parameterizable.

8. The adjusting method as claimed in claim 1, wherein the hydraulic cylinder units (8, 9; 10, 11) of the adjusting units are driven synchronously in position-controlled operation.

9. The adjusting method as claimed in claim 1 wherein adjustments are sent as predetermined values to the hydraulic cylinder units (8 to 11) in position-controlled operation in such a way that force-induced position fluctuations are compensated.

10. The adjusting method as claimed in claim 1, wherein in position-controlled operation the hydraulic cylinder units (8 to 11) are set to mutually independently determined adjustments.

11. The adjusting method as claimed in claim 1 wherein the adjusting unit causes a positive engagement between the metal billet (5) and the rollers (3) after changing over from positional control to pressure/force control.

* * * * *